United States Patent [19]

McMath

[11] 4,286,635

[45] Sep. 1, 1981

[54] AUTOMATIC SHUT-OFF NOZZLE HAVING AN ARRANGEMENT FOR CONTROLLING WHEN AUTOMATIC SHUT OFF OCCURS IN RESPONSE TO PRESSURE IN A SEALED TANK

[75] Inventor: Jack A. McMath, Fort Thomas, Ky.

[73] Assignee: Dover Corporation, New York, N.Y.

[21] Appl. No.: 77,332

[22] Filed: Sep. 20, 1979

Related U.S. Application Data

[63] Continuation of Ser. No. 917,911, Jun. 22, 1978, abandoned, which is a continuation-in-part of Ser. No. 811,551, Jun. 30, 1977, abandoned.

[51] Int. Cl.[3] ..... B65B 3/18; B65B 57/14

[52] U.S. Cl. ..... 141/98; 141/208; 141/226

[58] Field of Search ..... 141/198, 206–229, 141/98

[56] References Cited

U.S. PATENT DOCUMENTS

| | | | |
|---|---|---|---|
| 2,686,626 | 8/1954 | Slattery | 141/207 |
| 3,811,486 | 5/1974 | Wood | 141/208 |

*Primary Examiner*—Frederick R. Schmidt

*Attorney, Agent, or Firm*—Kinney & Schenk

[57] ABSTRACT

An automatic shut-off nozzle has a diaphragm responsive to the vapor pressure in a sealed tank to stop the liquid flow through the nozzle when a predetermined pressure exists in the sealed tank. The force of a spring, which acts on the side of the diaphragm not exposed to the vapor pressure in the tank, is adjusted to insure that the flow is stopped at the predetermined pressure.

26 Claims, 10 Drawing Figures

AUTOMATIC SHUT-OFF NOZZLE HAVING AN ARRANGEMENT FOR CONTROLLING WHEN AUTOMATIC SHUT OFF OCCURS IN RESPONSE TO PRESSURE IN A SEALED TANK

This application is a continuation of application Ser. No. 917,911, filed June 22, 1978, now abandoned, which is a continuation-in-part of application Ser. No. 811,551, filed June 30, 1977, now abandoned.

When filling a vehicle tank with gasoline through a dispensing nozzle, vapors from the gasoline within the tank can be prevented from escaping through the opening in which the spout of the nozzle is inserted by sealing the opening. Thus, the escape of the gasoline vapors into the atmosphere is prevented so that pollution of the atmosphere is decreased. The vapors within the tank can be recovered through vapor recovery equipment utilized in conjunction with the nozzle.

However, the sealing of the vehicle tank to insure that the vapors of the gasoline being supplied thereto do not escape into the atmosphere makes it necessary that the pressure within the tank not exceed a safe value. While the vapor recovery system of the nozzle normally prevents the pressure within the tank exceeding the safe value, the possibility exists that there could be a blockage in the vapor recovery passages in the nozzle or in the passages of the vapor recovery system, due to the condensing of vapors to a liquid form. If this blockage should occur, the pressure in the tank could exceed a safe value whereby the tank could rupture.

In U.S. Pat. No. 3,811,486 to Wood, there is shown an arrangement for stopping flow through the nozzle when the pressure in the tank exceeds a predetermined pressure. In my copending patent application for "Automatic Shut-Off Nozzle With Vapor Return Seal," Ser. No. 684,441, filed May 7, 1976, now abandoned, now continuation application 856,108 filed Nov. 30, 1977 now abandoned, and assigned to the same assignee as the assignee of this application, there is shown another arrangement for stopping the flow through the nozzle when the pressure in the tank exceeds a predetermined pressure.

While each of these arrangements is satisfactory when the predetermined pressure in the sealed tank can be in a range from twelve inches to twenty-six inches of a water column, for example, manufacturing tolerances in the parts vary so as to not always insure that the pressure will be at the lower end of the range such as twelve inches to fourteen inches, for example, particularly when the diaphragm has a relatively small diameter. To be able to sense the pressure in the sealed tank as close as possible to the sealed tank, the sensing arrangement should be mounted on the nozzle adjacent the spout. As a result, the diaphragm must have a relatively small diameter to enable the mounting of the housing of the sensing arrangement close to the spout and on the nozzle body.

To obtain automatic shut off of liquid flow through the nozzle body when the sealed tank has the vapor pressure therein increase only slightly to a pressure such as twelve inches to fourteen inches of a water column, for example, it is necessary that there be compensation for all of the tolerances of the various parts. Otherwise, because of the relatively small diameter of the diaphragm, the manufacturing tolerances may be such that automatic shut off of the liquid flow through the nozzle will not occur in response to the relatively low pressure in the sealed tank.

The present invention satisfactorily solves this problem through providing an arrangement for adjusting the force applied by a spring to means, which is preferably a diaphragm, responsive to the pressure in the sealed tank. Because of the relatively small diameter of the diaphragm, the tolerance of the spring itself is such that the nozzle may not cut off flow at the lower end of the pressure range. However, to obtain uniformity of the pressure to which any shut-off nozzle responds and to have this at the relatively low pressure of twelve inches to fourteen inches of a water column, for example, there must be compensation for the various tolerances including the tolerance of the spring acting on the responsive means, particularly when the diaphragm is of relatively small diameter.

The present invention obtains this shut off at the relatively low pressure through adjusting the length of the spring to adjust its force. Thus, the present invention enables any automatic shut-off nozzle to have its pressure responsive means controlled to respond to a predetermined pressure in the sealed tank irrespective of manufacturing tolerances in the various parts.

In some situations, it is necessary to cut off flow of liquid through the nozzle when the predetermined pressure in the sealed tank is in a range from six inches to ten inches of a water column, for example. When this very low range is required, it is necessary that the compensation for the tolerance of the spring acting on the responsive means be set so that it cannot accidentally change because of a torque having been applied thereto when being set. Otherwise, a slight reduction in the force exerted by the spring could cause any vapor pressure to stop flow so that flow could not occur.

A modification of this invention insures that the setting of the force of the spring will not change and that the nozzle will shut off at the relatively low pressure of six inches to ten inches of a water column through preventing application of any torque to the spring when its length is adjusted. If any torque is applied to the spring when it is adjusted, this torque eventually unwinds over a period of time so that the force exerted by the spring decreases whereby the nozzle would no longer be cut off in the desired low range of six inches to ten inches of a water column but would not even allow flow to exist.

This modification of the present invention also enables the diaphragm to have a relatively large area exposed to the pressure in a sealed tank. This allows the relatively low pressure in the sealed tank of six inches to ten inches of a water column to exert a sufficiently large force on the diaphragm so that the force exerted by the spring does not have to be as small as would be required if the diaphragm had a relatively small area.

This embodiment of the present invention also prevents the adjustment of the force of the spring from setting the force too high. This is accomplished by limiting the movement of the screw for decreasing the length of the spring to increase its force.

This form of the present invention also permits the control arrangement to be formed as a sub-assembly and to be set for the desired predetermined pressure at which the automatic shut-off nozzle stops flow prior to assembly on the nozzle body. This enables the final assembly of the nozzle to be quicker and less costly since it is normally not necessary to make any further adjustment and the parts of the sub-assembly are already assembled.

An object of this invention is to provide an automatic shut-off nozzle having an arrangement for controlling when automatic shut off occurs in response to pressure in a sealed tank.

Another object of this invention is to provide an arrangement for causing any automatic shut-off nozzle having the arrangement to automatically shut off in response to a predetermined pressure in a sealed tank.

A further object of this invention is to provide a sub-assembly having a control arrangement for an automatic shut-off nozzle.

Still another object of this invention is to provide a sub-assembly for an automatic shut-off nozzle in which most testing and adjusting of a control arrangement in the sub-assembly to automatically cause shut off of flow in response to a predetermined pressure in a sealed tank can occur prior to assembly of the sub-assembly on the nozzle body.

Other objects, uses, and advantages of this invention are apparent upon a reading of this description which proceeds with reference to the drawings forming part thereof and wherein.

Figure 1:
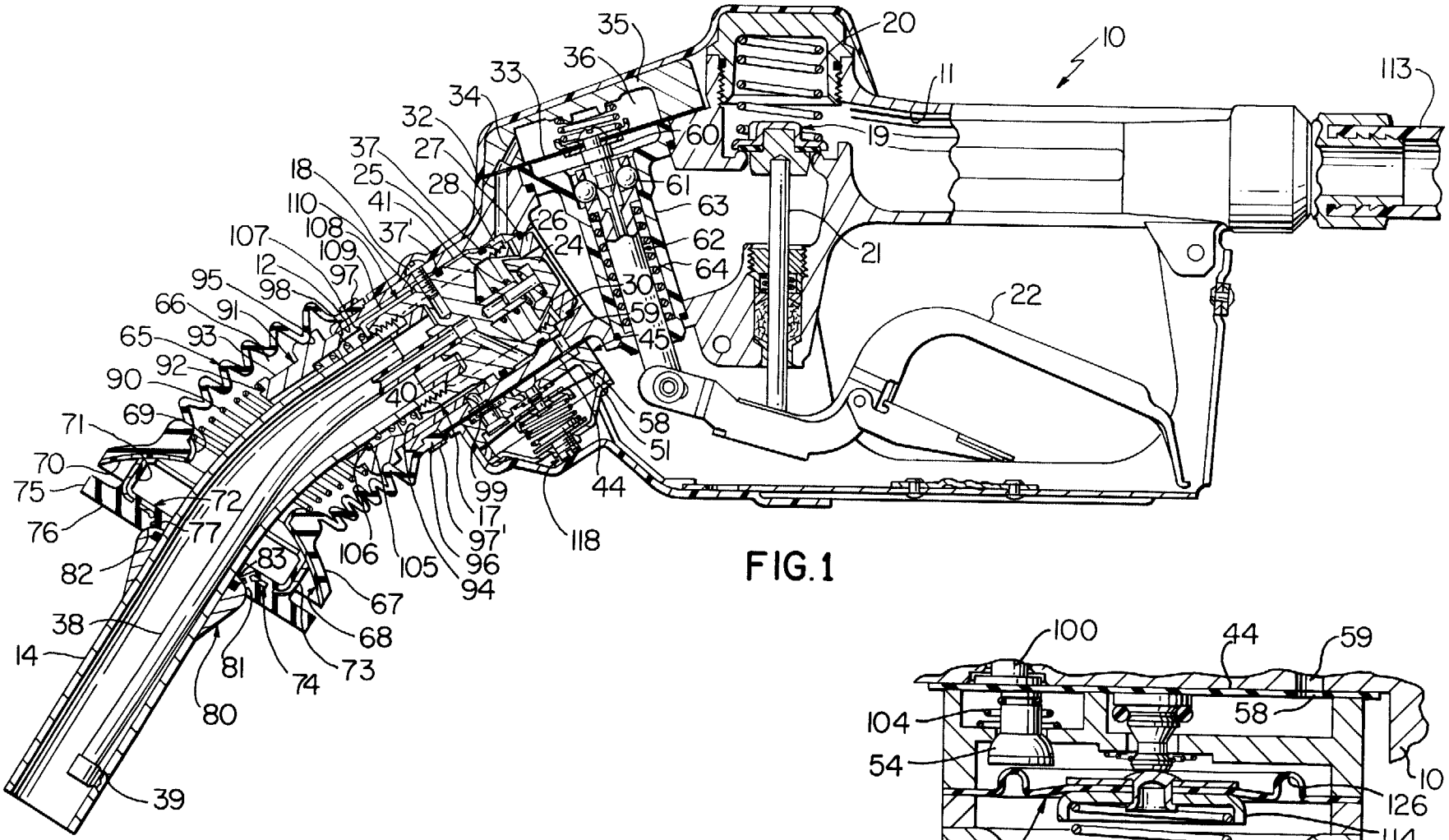
FIG. 1 is a sectional view, partly in elevation, of a nozzle having the control arrangement of the present invention.

Referring to the drawings and particularly FIG. 1, there is shown a nozzle body 10 having an inlet 11 to which a hose is connected to supply liquid such as gasoline, for example, to the interior of the body 10. The body 10 has an outlet 12 with which a spout 14 communicates to receive liquid from the interior of the body 10.

The spout 14, which is adapted to be inserted within an opening 15 (see FIG. 3) in a fill pipe 16 of a vehicle tank such as an automobile fuel tank, for example, has an end threaded in a spout adapter 17 (see FIG. 1). The spout adapter 17 is connected to the outlet 12 of the body 10 by a screw 18.

The body 10 has a first or main poppet valve 19 supported therein for control of the flow of liquid from the inlet 11 to the interior of the body 10 and from the interior of the body 10 to the outlet 12. A spring 20 continuously urges the poppet valve 19 to its closed position in which flow from the inlet 11 to the outlet 12 is stopped or prevented.

A stem 21 is connected to the poppet valve 19 and has its lower portion extending exteriorly of the body 10. The valve stem 21, which is slidably disposed within the body 10, is moved by a manually operated lever or handle 22. The stem 21 passes through the body 10 in the same manner as described in the aforesaid Wood patent.

A second poppet valve 24 is slidably mounted on the spout adapter 17 and is continuously urged by a spring 25 into engagement with a seat ring 26, which is secured to the spout adapter 17 by a threaded connection. A sealing ring 27 is disposed about the seat ring 26 to prevent liquid leakage into an annular chamber 28, which is formed between the body 10, the spout adapter 17, and the seat ring 26. Thus, only the pressure of liquid going from the inlet 11 and past the valve 19 can overcome the spring 25 and move the poppet valve 24 to an open position.

As the liquid flows between the poppet valve 24 and the seat ring 26, a venturi effect is created in radially extending passages 30 in the seat ring 26. The outer ends of the passages 30 communicate with the annular chamber 28. The passages 30 communicate through the chamber 28, a passage 32 in the body 10, an opening in a diaphragm 33, and a passage 34 in a cap 35 to a chamber 36, which is formed between the diaphragm 33 and the cap 35.

Sealing rings 37 and 37' are disposed between the spout adapter 17 and the body 10. These prevent air from entering the chamber 28 from exterior of the body 10.

The chamber 28 also communicates with a vacuum tube 38, which is connected with an opening 39 in the spout 14 adjacent the discharge or free end of the spout 14. The tube 38 communicates through a passage 40 in the spout adapter 17 with a chamber 41, which is formed between the sealing rings 37 and 37', the spout adapter 17, and the body 10. As shown in my aforesaid application, the chamber 41 communicates through a passage (not shown) in the nozzle body 10 and an opening (not shown) in a seal 44 (see FIG. 2), which is disposed between the body 10 and a housing 45 secured to the body 10, to a passage 46 in the housing 45.

The passage 46 in the housing 45 communicates through a passage 47 (see FIG. 2) in a divider 48 of the housing 45 with a chamber 49, which is formed between the divider 48 and a diaphragm 50. The diaphragm 50 is disposed between the housing 45 and a spacer 51. A cover or retainer 52 is disposed on the end of the spacer 51 so that four bolts 53 (two shown) can secure the cover 52, the spacer 51, the diaphragm 50, and the housing 45 to the nozzle body 10.

The flow through the passage 47 to the chamber 49 is controlled by a poppet valve 54. The chamber 49 communicates through a passage 55 in the divider 48 of the housing 45 with a chamber 56, which is formed within the housing 45 between the divider 48 and the seal 44. The passage 55 is controlled by a poppet valve 57, which is responsive to the diaphragm 50. The chamber 56 communicates through an opening 58 in the seal 44 and a passage 59 in the body 10 with the annular chamber 28.

Accordingly, as long as the poppet valves 54 and 57 are open and the opening 39 is not closed due to the liquid within the tank reaching a predetermined level that indicates that the tank is filled, the venturi effect created by the flow of the liquid between the seat ring 26 (see FIG. 1) and the poppet valve 24 draws air through the tube 38 to create a partial vacuum within the chamber 36. However, as soon as the opening 39 is blocked, the valve 54 is closed, or the valve 57 is closed, the chamber 36 has its pressure reduced due to the air therein being drawn therefrom because of the venturi effect in the passages 30 whereby the diaphragm 33 moves upwardly since the partial vacuum in the chamber 36 is increased. This venturi effect is more particularly described in U.S. Pat. No. 3,085,600 to Briede.

The diaphragm 33 has a latch retaining pin 60 secured thereto for movement therewith and disposed between three balls 61 (two shown), which are positioned within passages in a latch plunger 62. When the latch retaining pin 60 is in the position shown in FIG. 1, the balls 61 prevent downward movement of the plunger 62, which is slidably mounted within an insert 63. The insert 63, which is preferably formed of a plastic, is supported in the body 10.

When the diaphragm 33 is moved upwardly due to the increase in the partial vacuum in the chamber 36, the latch retaining pin 60 is moved upwardly therewith. The upward movement of the retaining pin 60 disposes a tapered portion of the retaining pin 60 between the balls 61 whereby the balls 61 may move inwardly to allow the plunger 62 to move downwardly against the force of its spring 64. The correlation between the tapered portion of the pin 60 and the latch plunger 62 is more specifically shown in U.S. Pat. No. 2,582,195 to Duerr.

The lower end of the plunger 62 is connected to the handle 22 as more particularly shown and described in U.S. Pat. No. 3,817,285 to Wilder et al. Thus, when the diaphragm 33 moves upwardly to pull the latch retaining pin 60 and release the latch plunger 62 from the balls 61, the force of the spring 20 closes the main poppet valve 19 as more particularly shown and described in the aforesaid Wilder patent.

The body 10 has a bellows 65, which is preferably formed of a gasoline resistant synthetic rubber, secured thereto and extending from the outlet 12 of the body 10 towards the free or discharge end of the spout 14. The bellows 65 is disposed in spaced relation to the spout 14 to form an annular passage 66 therebetween.

The end of the bellows 65 remote from the outlet 12 of the body 10 has a member 67, which is preferably formed integral therewith. The member 67 has a member 68, which is acetal plastic, for example, connected thereto by the member 68 having its curved portion snapped into the bellows 65 and retained therein by the resilience of the bellows 65. The member 68 has an opening 60 formed in the center thereof to enable the member 68 to slide along the spout 14.

The member 68 has its surface 70 formed as a sector of a sphere so that a cylindrical extension 71 of a member 72, which is preferably formed of the same material as the member 67, engages the surface 70 irrespective of the position of the member 72 on the spout 14. The member 72 has its cylindrical extension 71 supported by a cylindrical extension 73 of a plate 74, which is preferably formed of a suitable metal such as stainless steel, for example. The member 72 is molded integral with the plate 74 so that the cylindrical extension 71 of the member 72 is secured to the cylindrical extension 73 of the plate 74.

The plate 74 has openings formed therein so that the member 72 has a disc 75 disposed on the opposite side of the plate 74 from the cylindrical extension 71. Thus, the member 72, the plate 74, and the disc 75 form a sealing member with the disc 75 having its flat surface 76 functioning as a sealing surface. The member 72, the plate 74, and the disc 75 have an opening 77 to enable them to be both slidably and rotatably mounted on the spout 14.

A retainer 80, which functions as a stop, is fixed to the spout 14 between the disc 75 and the discharge or free end of the spout 14 by suitable means such as a set screw or welding, for example. The retainer 80 has a curved surface 81, preferably formed as a portion of a sphere as more particularly shown and described in U.S. Pat. No. 4,003,415 to Lasater. The disc 75 has an inner curved surface 82, preferably formed as a sphere as more particularly shown and described in the aforesaid Lasater patent, engaging the curved surface 81 of the retainer 80 to form a seal therewith when the spout 14 is not inserted within the opening 15 (see FIG. 3) of the fill pipe 16.

The retainer 80 has an inner flat surface 83, which is disposed inside of the surface 81. The surface 83 functions to lock the spout 14 within the fill pipe 16 through cooperation with a lip 84 of the fill pipe 16 as shown in FIG. 3.

Accordingly, when the spout 14 is not inserted in the opening 15 of the fill pipe 16, the annular passage 66, which is connected to the vapor recovery equipment, is not connected to the atmosphere but is sealed through the cylindrical extension 71 of the member 72 engaging the surface 70 of the member 68 and the disc 75 having its inner curved surface 82 engage the outer curved surface 81 of the retainer 80 as shown in FIG. 1. When the spout 14 is inserted into the opening 15 (see FIG. 3) of the fill pipe 16, the outer flat surface 76 of the disc 75 abuts the end of the fill pipe 16 so as to not follow the movement of the spout 14 and the retainer 80 into the fill pipe 16. This results in the bellows 65, which continuously urges the member 68 toward the free end of the spout 14 so that the spherical surface 70 of the member 68 is always in engagement with the cylindrical extension 71 of the member 72 and the cylindrical extension 73 of the plate 74, being slightly compressed.

Figure 3:
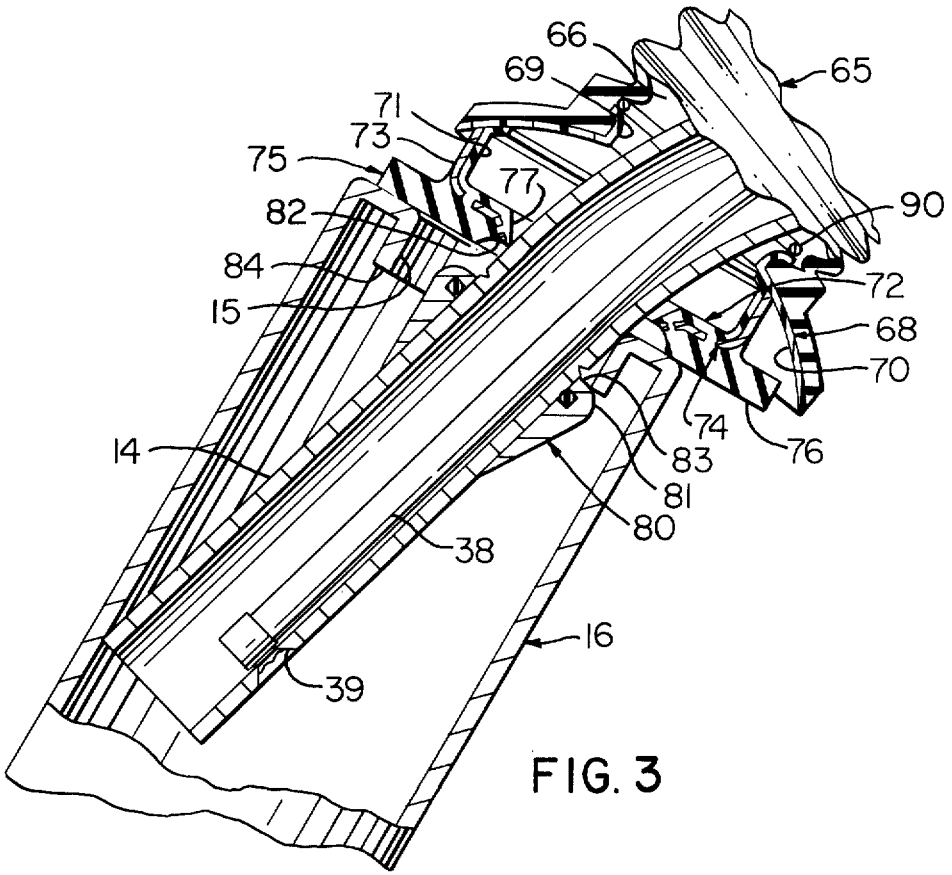
FIG. 3 is a sectional view, partly in elevation, of a portion of the nozzle of FIG. 1 and showing the spout in the fill pipe of a vehicle tank with the seal and the vapor return means being effective.

Accordingly, when the spout 14 is in the position of FIG. 3, vapor within the tank can flow through the opening 15 in the fill pipe 16 and the opening 69 into the annular passage 66 from which it flows to the vapor recovery equipment. Thus, the movement of the spout 14 into the fill pipe opening 15 results in the seal between the disc 75 and the retainer 80 being broken whereby the vapor can be removed from the tank being filled.

When the sealing surface 76 of the disc 75 engages the end of the fill pipe 16 so as to not follow the movement of the spout 14 and the retainer 80 into the fill pipe opening 15, this stopping of the movement of the disc 75 is transmitted through a spring 90 to an interlock sleeve 91 (see FIG. 1), which surrounds the spout 14 and a portion of the spout adapter 17 and extends between the outlet 12 of the body 10 and the spout adapter 17. The interlock sleeve 91 has a shoulder 92 on one end and against which one end of the spring 90 bears. The other end of the spring 90 abuts the member 68.

The shoulder 92 is formed at an angle to the longitudinal axis of the sleeve 91 so that a force is produced on the top of the spout 14 substantially equal to the force on the bottom when the spout 14 is inserted into the fill pipe opening 15. This formtion of the shoulder 92 at an angle to the longitudinal axis of the sleeve 91 also results in the direction of the spring 90 conforming to the configuration of the spout 14.

To provide the shoulder 92 at an angle to the longitudinal axis of the sleeve 91, the sleeve 91 has its head 93 formed so that it decreases in size from the top to the bottom. A cylindrical-shaped skirt 94 extends from the head 93 and is disposed between the body 10 and the spout adapter 17.

A groove 95 is formed in the head 93 of the interlock sleeve 91 adjacent the skirt 94. A portion of the bellows 65 is disposed in the groove 95 and retained therein by being squeeze fitted, for example, in the groove 95 so as to prevent leakage through the groove 95. Thus, the bellows 65 and the interlock sleeve 91 move together.

The bellows 65 also is secured to the body 10. The bellows 65 has an enlarged portion 96 for disposition in a groove 97 in the periphery of the body 10. A clamp 97' is disposed around the enlarged portion 96 of the bellows 65 to hold the enlarged portion 96 in the groove 97.

The skirt 94 has a longitudinal slot 98 therein. A cam surface 99 is formed in the skirt 94 diametrically opposite to the longitudinal slot 98 for cooperation with an actuator pin 100 (see FIG. 2), which is disposed in a passage 101 in the body 10.

Accordingly, when the spout 14 is disposed in the fill pipe opening 15 so that the flat surface 76 of the disc 75 engages the end of the fill pipe 16 to stop movement of the disc 75, the continued movement of the spout 14 into the fill pipe opening 15 causes the body 10, which has the spout 14 attached thereto through the spout adapter 17, to move relative to the interlock sleeve 91. As a result, the actuator pin 100, which has an end disposed within a passage 102 in the skirt 94 of the interlock sleeve 91, moves with the body 10 so as to move into engagement with the cam surface 99 in the skirt 94 of the interlock sleeve 91. The engagement of the actuator pin 100 with the cam surface 99 cams the actuator pin 100 from the position of FIG. 2.

The actuator pin 100 has its head 103 bearing against the seal 44 and acting therethrough on one end of the poppet valve 54. A spring 104 continuously urges the poppet valve 54 to its closed position in which it blocks the passage 47. The spring 104 also urges the actuator pin 100 into the passage 102 in the skirt 94 of the interlock sleeve 91 so that the actuator pin 100 cannot be moved out of the passage 102 except by the cam surface 99.

Thus, when there is relative movement between the interlock sleeve 91 and the spout 14 due to the spout 14 being inserted in the fill pipe opening 15 and the flat surface 76 of the disc 75 abutting the end of the fill pipe 16 with sufficient force to effectively form a seal around the fill pipe opening 15, the poppet valve 54 is moved to an open position through the actuator pin 100 acting on the end of the poppet valve 54 through the seal 44. The opening of the poppet valve 54 allows air to flow from the inlet opening 39 in the spout 14 and through the vacuum tube 38, the passage 40 in the spout adapter 17, the annular chamber 41, the passage (not shown) in the body 10, the opening (not shown) in the seal 44, the passage 46 (see FIG. 2) in the housing 45, the passage 47 in the divider 48, the chamber 49, the passage 55 in the divider 48, the chamber 56, the opening 58 in the seal 44, the passage 59 in the body 10, and the annular chamber 28 to the passages 30 (see FIG. 1) in the seat ring 26. This provides a supply of air so that the partial vacuum created in the chamber 36 by the venturi effect is not increased.

Accordingly, the interlock sleeve 91 allows flow through the body 10 only if the disc 75 has the flat surface 76 in sealing engagement with the end of the fill pipe 16 (see FIG. 3) when the spout 14 is inserted in the fill pipe opening 15 to supply the liquid thereto. If the flat surface 76 of the disc 75 does not engage the end of the fill pipe 16 with sufficient force to form a seal around the fill pipe opening 15, then there will not be the desired relative motion of the spout 14, the spout adapter 17, and the body 10 with respect to the interlock sleeve 91 (see FIG. 1). This prevents the poppet valve 54 (see FIG. 2) from being opened so that air is not supplied to the passages 30 (see FIG. 1) in the seat ring 26. The lack of air to the passages 30 in the seat ring 26 causes the partial vacuum in the chamber 36 to increase to close the main poppet valve 19 so that liquid cannot flow through the body 10 and the spout 14.

It should be understood that the main poppet valve 19 must be opened and flow to occur for the partial vacuum to be produced in the chamber 36. However, only a small amount of liquid will flow through the spout 14 before the poppet valve 19 is automatically closed by the increased partial vacuum in the chamber 36. This is because the poppet valve 54 (see FIG. 2) always is closed unless the flat surface 76 (see FIG. 3) of the disc 75 is engaging the end of the fill pipe 16 with sufficient force to effectively form a seal around the fill pipe opening 15 and the spout 14 has been inserted into the fill pipe opening 15 a sufficient distance to produce the necessary relative motion to cause the poppet valve 54 (see FIG. 2) to be opened.

Therefore, the poppet valve 54 is closed unless necessary relative motion has occurred. As a result of the poppet valve 54 being closed, opening of the main poppet valve 19 (see FIG. 1) to produce the necessary flow past the passages 30 in the seat ring 26 to produce the partial vacuum in the chamber 36 automatically increases the partial vacuum in the chamber 36 whereby the main poppet valve 19 is automatically closed shortly after being opened.

When the spout 14 is removed from the fill pipe opening 15 (see FIG. 3) so that the flat surface 76 of the disc 75 does not engage the end of the fill pipe 16, a return spring 105 (see FIG. 1), which acts between the inner flange 106 on the interlock sleeve 91 and a ring 107 of a guide 108, produces the relative motion of the spout 14, the spout adapter 17, and the body 10 with respect to the interlock sleeve 91. Thus, the interlock sleeve 91 moves relative to the actuator pin 100 (see FIG. 2), which is within the body 10 at this time, so that the pin 100 can again enter the passage 102 in the skirt 94 of the interlock sleeve 91. When this occurs, the poppet valve 54 is returned to its closed position by the spring 104. Closing of the poppet valve 54 stops air flow through the vacuum tube 38 (see FIG. 1) so that the diaphragm 33 is caused to move upwardly to release the latch plunger 62 from the balls 61 whereby the spring 20 closes the main poppet valve 19 to automatically stop flow of liquid through the body 10 if it has not been stopped by the manually operated handle 22.

The guide 108 has a leg 109 extending from the ring 107 and formed with a slot 110 in its end. The slot 110 aligns the guide 108 with the spout adapter 17.

The ring 107 of the guide 108 is continuously urged against the end of the spout adapter 17 by the return spring 105. The leg 109 of the guide 108 cooperates with the longitudinal slot 98 in the interlock sleeve 91 to insure that the interlock sleeve 91 is properly oriented so that the actuator pin 100 is received in the passage 102 in the interlock sleeve 91.

As more particularly shown in my aforesaid application, the skirt 94 of the interlock sleeve 91 has a longitudinal cut out portion formed therein with its centerline 90° from the centerline of the slot 98. The cut out portion, which extends for the length of the skirt 94, provides communication from the interior of the interlock sleeve 91 to a vapor return passage (not shown) in the body 10. As shown in my aforesaid application, the vapor return passage in the body 10 communicates through a hose 113 with the vapor recovery equipment. By extending the longitudinal cut out portion for the length of the skirt 94 of the interlock sleeve 91, this insures that the movement of the interlock sleeve 91 will not prevent communication from the interior thereof to the vapor return passage in the body 10.

As previously mentioned, the poppet valve 57 (see FIG. 3) is responsive to the diaphragm 50, which has a cup washer 114 secured thereto at its center by a rivet 115. One end of a spring 116 acts against the cup washer 114 to exert a force on the diaphragm 50. The other end of the spring 116 bears against a shoulder 117, which is a plate, of a force control means 118. The force control means 118 includes a guide 119, which has a round shape, extending into the spring 116 from the shoulder 117. The force control means 118 has a screw 120 extending through a threaded opening 121 in the cover 52. The force control means 118 is formed of a suitable plastic, for example, so that the screw 120 has an interfitting engagement with the threaded opening 121 whereby the screw 120 will remain in the position to which it is moved.

By adjusting the position of the screw 120 within the threaded opening 121 in the cover 52, the length of the spring 116 between the shoulder 117 and the cup washer 114 can be adjusted. As this length is increased, the force exerted by the spring 116 on the diaphragm 50 decreases. A decrease in the length of the spring 116 through moving the shoulder 117 closer to the cup washer 114 causes an increase in the force that the spring 116 exerts on the diaphragm 50.

A spring 122 has one end disposed in a groove 123 in the poppet valve 57 so that the spring 122 urges the poppet valve 57 to its closed position. The force of the spring 122 is not as strong as the force of the spring 116, which urges the poppet valve 57 to its normally open position through the rivet 115 in the diaphragm 50 being held against the end of the poppet valve 57 by the spring 116. Thus, the spring 116 normally holds the poppet valve 57 in its open position.

However, if the vapor pressure in the tank, which is being filled and has the fill pipe opening 15 (see FIG. 3) sealed by the flat surface 76 of the disc 75 engaging the end of the fill pipe 16, increases beyond a predetermined pressure, the diaphragm 50 (see FIG. 3) is moved against the force of the spring 116, which has its force controlled by the force control means 118, to permit the poppet valve 57 to move to its closed position in response to the action of the spring 122. When this occurs, air from the inlet opening 39 (see FIG. 1) to the passages 30 in the seat ring 26 is stopped so that the partial vacuum in the chamber 36 is increased to cause automatic closing of the main poppet valve 19. This response of the diaphragm 50 (see FIG. 2) to the vapor pressure in the sealed tank is more particularly shown and described in the aforesaid Wood patent.

After the nozzle body 10 has been assembled, it can be tested to determine the pressure in the sealed tank at which automatic shut off would occur. If this pressure is not within the desired range such as twelve to fourteen inches of a water column, for example, then the force control means 118 is adjusted through turning the screw 120 to change the force exerted by the spring 116 on the diaphragm 50 until the desired pressure is obtained.

The operation of the nozzle with the force control means 118 of the present invention is the same as that described in my aforesaid application. With the force control means 118 of the present invention, the only difference is that each nozzle will have been tested at the factory and have the force of the spring 116 adjusted so that the diaphragm 50 of each nozzle responds to the same low pressure range in a sealed tank.

Figure 4:
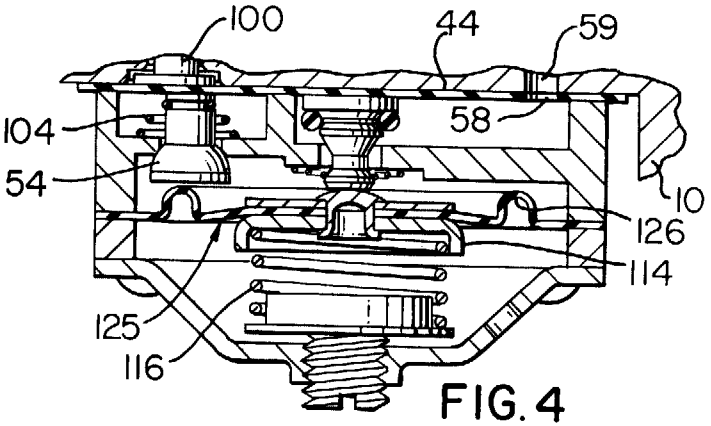
FIG. 4 is an enlarged fragmentary sectional view of another form of the control arrangement of the present invention.

Referring to FIG. 4, there is shown another arrangement of the present invention in which the diaphragm 50 is replaced by a diaphragm 125. The diaphragm 125 has a convolution 126 therein. One suitable example of the diaphragm 125 is sold by Bellofram Corporation, Burlington, Mass.

The convolution 126 in the diaphragm 125 enables any stretching of the diaphragm 125 or stresses provided thereon to be absorbed by the convolution 126 rather than by the portion of the diaphragm 125 to which the cup washer 114 is secured. Thus, this permits an ever closer tolerance of the force exerted by the spring 116 on the diaphragm 125 since there is no effect on the diaphragm 125 due to stretching or other stresses. Therefore, the net force of the spring 116 is not affected by any stresses or stretching of the diaphragm 125 as could be possible when using the diaphragm 50.

Figure 5:
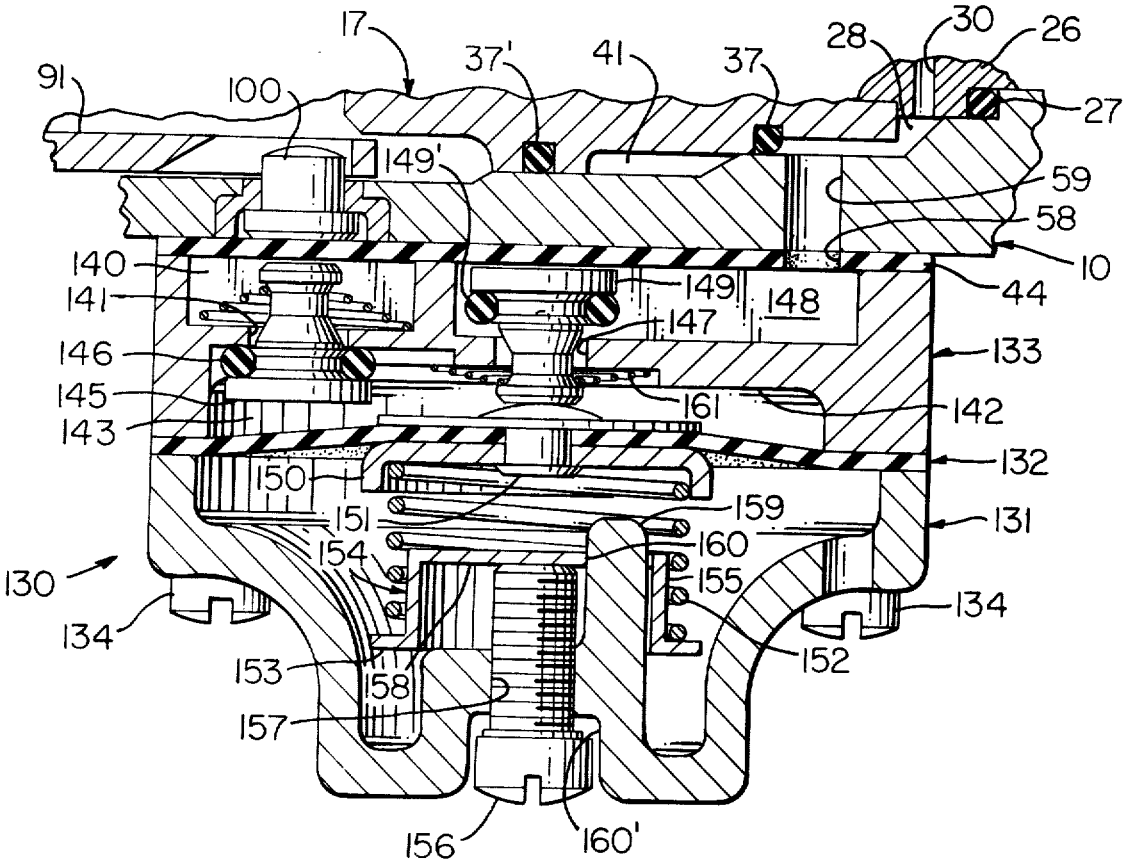
FIG. 5 is an enlarged fragmentary sectional view of a further embodiment of the control arrangement of the present invention in which the control arrangement is a sub-assembly of the nozzle.
Figure 7:
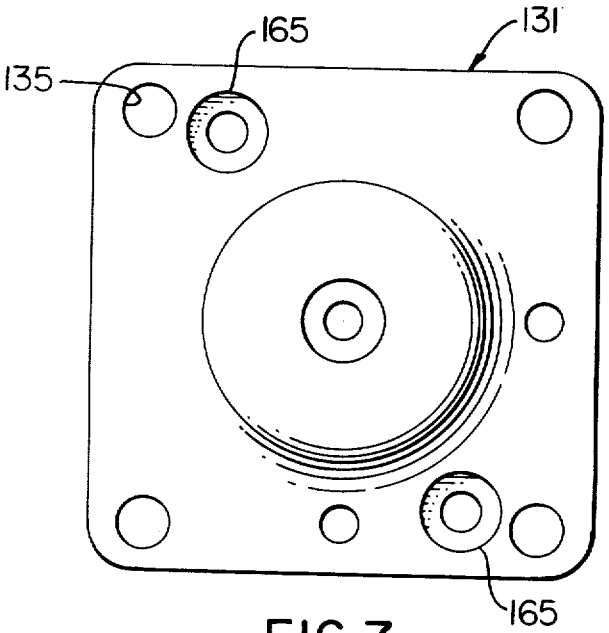
FIG. 7 is a plan view of a pressure cap of the sub-assembly of FIG. 5.
Figure 8:
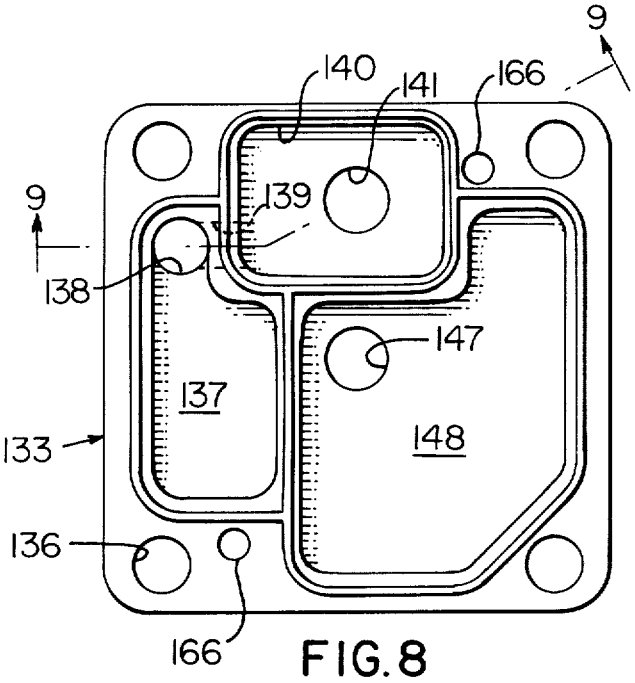
FIG. 8 is a plan view of a valve seat of the sub-assembly of FIG. 5 and looking in the direction away from the nozzle body against which it bears when the sub-assembly of FIG. 5 is mounted on the nozzle body.

Referring to FIG. 5, there is shown a further modification of the present invention in which a sub-assembly 130 is mounted on the nozzle body 10. The sub-assembly 130 includes a pressure cap or cover 131, a diaphragm 132, and a valve seat 133. The sub-assembly 130 is retained on the nozzle body 10 by four bolts 134 (two shown) extending through holes 135 (see FIG. 7) in the four corners of the pressure cap 131, holes (not shown) in the four corners of the diaphragm 132, and holes 136 (see FIGS. 8 and 10) in the four corners of the valve seat 133. The valve seat 133 of the sub-assembly 130 bears against the seal 44 (see FIG. 5) to hold the seal 44 in position.

The valve seat 133 has a chamber 137 (see FIG. 8) therein communicating through an opening (not shown) in the seal 44 (see FIG. 5), which is disposed between the body 10 and the valve seat 133, and a passage (not shown) in the nozzle body 10 to the chamber 41. As previously mentioned, the chamber 41 is in communication with the sealed tank through the vacuum tube 38 (see FIG. 1).

Figure 9:
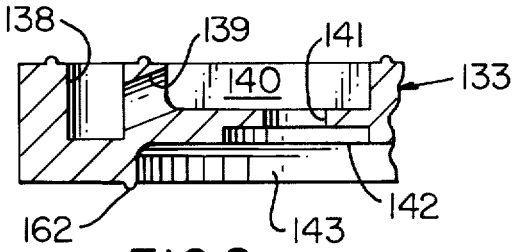
FIG. 9 is a fragmentary sectional view of the valve seat of FIG. 8 and taken along line 9—9 of FIG. 8.

The chamber 137 (see FIG. 8) communicates through a passage 138 in the valve seat 133 and a passage 139 (see FIGS. 8 and 9) with a chamber 140 in the valve seat 133. As shown in FIG. 5, the chamber 140 in the valve seat 133 communicates through a passage 141 in a divider 142 of the valve seat 133 with a chamber 143, which is formed between the divider 142 and the diaphragm 132.

Flow through the passage 141 to the chamber 143 is controlled by a poppet valve 145. The poppet valve 145 has an O-ring 146 mounted therein to engage the divider 142 to form a seal therebetween.

The chamber 143 communicates through a passage 147 in the divider 142 of the valve seat 133 with a chamber 148, which is formed within the valve seat 133 between the divider 142 and the seal 44. The passage 147 is controlled by a poppet valve 149, which has an O-ring 149' to engage the divider 142 to form a seal therebetween and is responsive to the diaphragm 132. The chamber 148 communicates through the opening 58 in the seal 44 and the passage 59 in the nozzle body 10 with the annular chamber 28 in the same manner as described for the embodiment of FIGS. 1–3.

As previously mentioned, the poppet valve 149 is responsive to the diaphragm 132, which has a cup washer 150 secured thereto at its center by a rivet 151. One end of a spring 152 acts against the cup washer 150, which is disposed on the opposite side of the diaphragm 132 to the poppet valve 149, to exert a force on the diaphragm 132. The other end of the spring 152 bears against a shoulder or annular lip 153 on a second cup washer 154. The second cup washer 154 has a cylindrical portion 155 extending into the spring 152 to function as a guide for the spring 152.

A screw 156 extends through a threaded opening 157 in the pressure cap 131. The end of the screw 156 acts against a flat portion 158 of the second cup washer 154.

By adjusting the position of the screw 156 within the threaded opening 157 in the pressure cap 131, the length of the spring 152 between the shoulder 153 of the second cup washer 154 and the cup washer 150 can be adjusted. As this length is increased, the force exerted by the spring 152 on the diaphragm 132 decreases. A decrease in the length of the spring 152 through moving the shoulder 153 closer to the cup washer 150 causes an increase in the force that the spring 152 exerts on the diaphragm 132.

As the screw 156 acts on the flat portion 158 of the second cup washer 154, there could be some turning or rotation of the second cup washer 154 to produce a torque on the spring 152. This increased torque would eventually be lost due to the spring 152 unwinding over a period of time. Therefore, the diaphragm 132 would not be having the desired force exerted thereon when this occurs so that it would not be responsive to the relative low pressure of six to ten inches of a water column, for example, but might close when the tank is sealed so as to prevent flow through the nozzle body 10.

Figure 6:
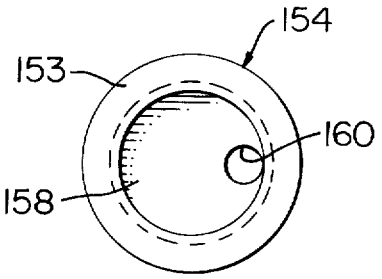
FIG. 6 is a plan view of a cup washer of the sub-assembly of FIG. 5 against which the adjusting screw acts.

Accordingly, a guide pin 159 on the pressure cap 131 extends into a hole 160 (see FIGS. 5 and 6) in the flat portion 158 of the second cup washer 154. This prevents any rotation or turning of the second cup washer 154 when the adjusting screw 156 is turned in the threaded opening 157 in the pressure cap 131. As a result, there is only axial motion of the second cup washer 154 in the axial direction of the spring 152. Thus, no torque is imparted to the spring 152 by turning of the screw 156 because the second cup washer 154 is prevented from rotating.

The pressure cap 131 has a recess 160' in its end to receive the head of the screw 156 when the screw 156 is advanced through the threaded opening 157. The inner wall of the recess 160' limits the axial movement of the screw 156 through the threaded opening 157 to limit the maximum force of the spring 152 on the diaphragm 132.

A spring 161 has one end acting on the poppet valve 149 and its other end engaging the divider 142 of the valve seat 133 so that the spring 161 urges the poppet valve 149 to its closed position. The force of the spring 161 is not as strong as the force of the spring 152, which urges the poppet valve 149 to its normally open position through the rivet 151 in the diaphragm 132 being held against the end of the poppet valve 149 by the spring 152. Thus, the spring 152 normally holds the poppet valve 149 in its open position.

Figure 2:
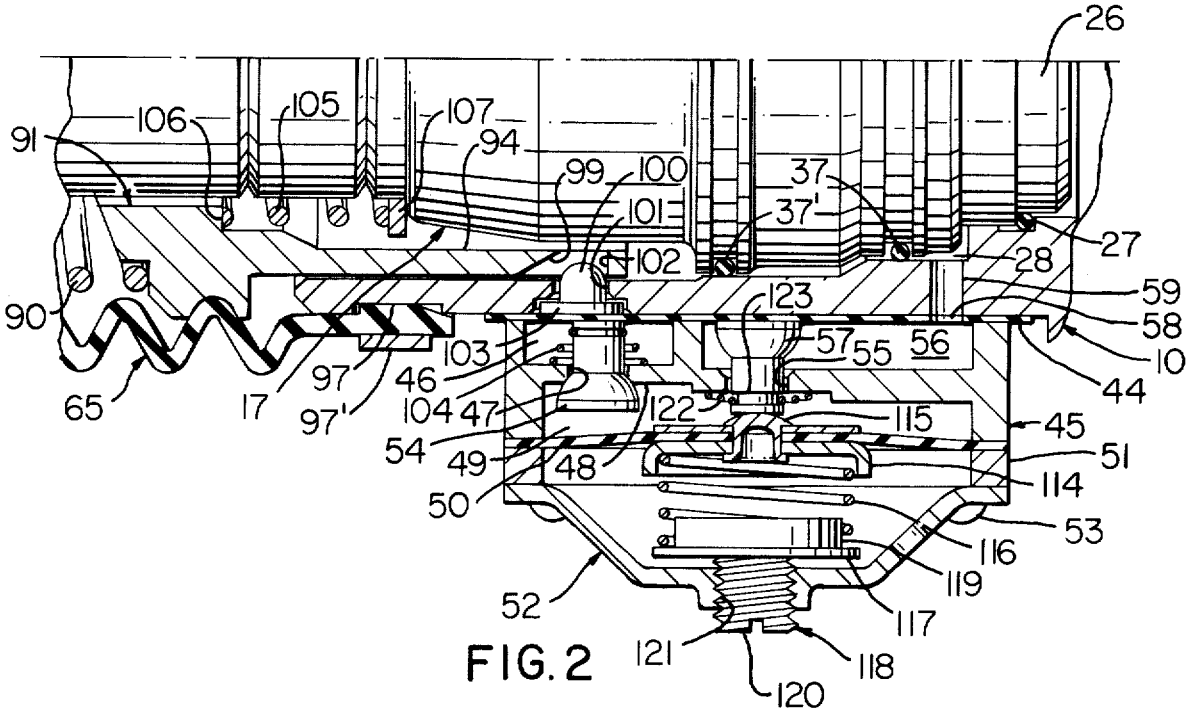
FIG. 2 is an enlarged fragmentary sectional view, partly in elevation, of a portion of the nozzle including the control arrangement of the present invention.

However, if the vapor pressure in the tank, which is being filled when the fill pipe opening 15 (see FIG. 3) is sealed in the manner described for the embodiment of FIGS. 1–3, increases beyond a predetermined pressure, the diaphragm 132 (see FIG. 3) is moved against the force of the spring 152, which has its force controlled by the position of the second cup washer 154, to permit the poppet valve 149 to move to its closed position in response to the action of the spring 161. When this occurs, air from the inlet opening 39 (see FIG. 1) to the passages 30 in the seat ring 26 is stopped so that the partial vacuum in the chamber 36 is increased to cause automatic closing of the main poppet valve 19. This response of the diaphragm 132 (see FIG. 5) to the vapor pressure in the sealed tank is more particularly shown and described in the aforesaid Wood patent.

It should be understood that the poppet valve 145 is controlled by the interlock sleeve 91 as previously described for the embodiment of FIGS. 1–3. Thus, the poppet valve 145 (see FIG. 5) is moved to an open position when the end of the fill pipe 16 (see FIG. 3) is sealed with the spout 14 therein.

Figure 10:
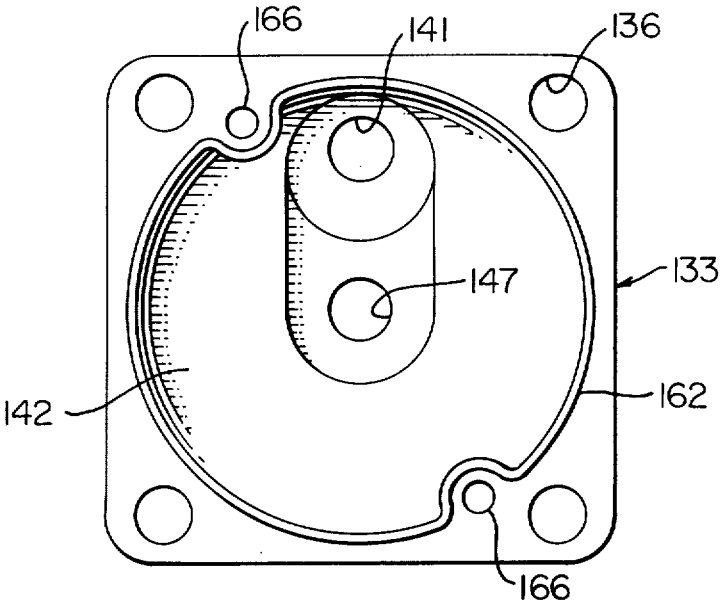
FIG. 10 is a plan view of the valve seat of the sub-assembly of FIG. 5 and taken from the opposite side of the valve seat to FIG. 8.

As shown in FIG. 10, the valve seat 133 has a rim or projection 162 thereon and against which the diaphragm 132 (see FIG. 5) engages. The rim or projection 162 (see FIG. 10) is disposed close to the periphery of the valve seat 133 to enable a substantially large area of the diaphragm 132 (see FIG. 5) to be exposed to the pressure within the chamber 143. This allows a smaller pressure in the sealed tank to produce the same force on the diaphragm 132 as would be produced by a larger pressure with a smaller exposed area of the diaphragm 132.

The pressure cap 131 and the valve seat 133 are secured to each other by a pair of self-tapping screws (not shown), which extend through a pair of diametrically disposed countersunk holes 165 (see FIG. 7) in the pressure cap 131 and into holes 166 (see FIG. 10) in the valve seat 133 into which the self-tapping screws tap. As clearly shown in FIG. 10, the holes 166 are outside of the rim or projection 162, which is circular except for the arcuate portions which pass inside of the holes 166, so that the self-tapping screws do not pass through the portion of the diaphragm 132 (see FIG. 5) forming the flexible wall of the chamber 143, but the self-tapping screws do pass through holes (not shown) in the diaphragm 132 exterior of the rim or projection 162 (see FIG. 10).

In forming the sub-assembly 130 (see FIG. 5), the second cup washer 154 is mounted so that the hole 160 in the flat portion 158 receives the guide pin 159 on the pressure cap 131. Then, the spring 152 is disposed over the cylindrical portion 155 of the second cup washer 154. The diaphragm 132 is then positioned on the end of the pressure cap 131 with the holes for the self-tapping screws in the diaphragm 132 aligned with the holes 165

(see FIG. 7) in the pressure cap 131. The valve seat 133 (see FIG. 5), which has the poppet valves 145 and 149 mounted therein, is next positioned with the holes 166 (see FIG. 10) therein aligned with the holes 165 (see FIG. 7) in the pressure cap 131 and the holes in the diaphragm 132 (see FIG. 5) for the self-tapping screws. Then, the self-tapping screws are employed to join the pressure cap 131, the diaphragm 132, and the valve seat 133 to each other to form the sub-assembly 130.

Accordingly, the pressure cap 131, the diaphragm 132, and the valve seat 133 can be assembled as the sub-assembly 130 prior to being secured to the nozzle body 10 at final assembly by the bolts 134. Thus, the sub-assembly 130 can be tested through the use of pressure gauges so that the diaphragm 132 moves the poppet valve 149 to a closed position at a desired predetermined pressure such as six to ten inches of a water column, for example.

Then, during final assembly, the sub-assembly 130 is attached to the nozzle body 10 by the bolts 134. A further check is then made to ascertain that the setting of the spring 152 is still satisfactory. If it is, the adjusting screw 156 is locked in the position by a suitable locking compound.

An advantage of this invention is that a slight increase in the pressure in a sealed tank can be quickly responded to to stop liquid flow to the tank. Another advantage of this invention is that the nozzle automatically shuts off when a relatively low pressure exists within the sealed tank. A further advantage of this invention is that one embodiment provides an enlarged effective area for the diaphragm. Still another advantage of this invention is that the control arrangement can be a sub-assembly tested and adjusted for a predetermined pressure prior to final assembly.

For purposes of exemplification, particular embodiments of the invention have been shown and described according to the best present understanding thereof. However, it will be apparent that changes and modifications in the arrangement and construction of the parts thereof may be resorted to without departing from the spirit and scope of the invention.

What is claimed is:

1. An automatic shut-off nozzle comprising a body having an inlet and an outlet, a valve in said body controlling flow of liquid from said inlet to said outlet, manual operated means controlling the operation of said valve, a spout communicating with said outlet and having its free end for disposition in an opening of a fill pipe of a vehicle tank or the like, release means to release said manual operated means to allow closing of said valve and stoppage of liquid flow, means to return vapor from the tank being filled, sealing means to form a seal between the fill pipe opening and said vapor return means when said spout is disposed in the fill pipe, responsive means responsive to the pressure in the sealed tank to cause said release means to close said valve to stop liquid flow through said body when the pressure in the sealed tank exceeds a predetermined pressure, means exerting a force on said responsive means in opposition to the pressure in the sealed tank acting on said responsive means, and force control means to control the force exerted by said exerting means on said responsive means to cause said responsive means to respond at the predetermined pressure.

2. The nozzle according to claim 1 in which said responsive means includes flexible means having one side exposed to the pressure in the sealed tank, said exerting means includes resilient means acting on the other side of said flexible means to exert a force on said flexible means, and said force control means controls the force exerted on said flexible means by said resilient means to control the predetermined pressure at which said responsive means responds.

3. The nozzle according to claim 2 in which said force control means includes means to change the length of said resilient means.

4. The nozzle according to claim 3 in which said flexible means includes a diaphragm.

5. The nozzle according to claim 2 in which said force control means includes support means, said resilient means includes a spring having one end acting on said flexible means and its other end acting on said support means of said force control means, and said force control means includes shifting means, separate from said support means, supported by said body and exerting a force on said support means when said shifting means is moved relative to said body to shift the position of said support means to change the length of said spring.

6. The nozzle according to claim 5 in which said flexible means includes a diaphragm.

7. The nozzle according to claim 5 including a fixed member supported by said body and said shifting means being supported by said fixed member for motion relative thereto.

8. The nozzle according to claim 2 in which said flexible means includes a diaphragm.

9. An automatic shut-off nozzle comprising a body having an inlet and an outlet, a valve in said body controlling flow of liquid from said inlet to said outlet, manual operated means controlling the operation of said valve, a spout communicating with said outlet and having its free end for disposition in an opening of a fill pipe of a vehicle tank or the like, release means to release said manual operated means to allow closing of said valve and stoppage of liquid flow, means to return vapor from the tank being filled, sealing means to form a seal between the fill pipe opening and said vapor return means when said spout is disposed in the fill pipe, responsive means responsive to the pressure in the sealed tank to cause said release means to close said valve to stop liquid flow through said body when the pressure in the sealed tank exceeds a predetermined pressure, means exerting a force on said responsive means in opposition to the pressure in the sealed tank acting on said responsive means, force control means to control the force exerted by said exerting means on said responsive means to cause said responsive means to respond at the predetermined pressure, said responsive means including flexible means having one side exposed to the pressure in the sealed tank, said exerting means including resilient means acting on the other side of said flexible means to exert a force on said flexible means, said force control means controlling the force exerted on said flexible means by said resilient means to control the predetermined pressure at which said responsive means responds, said force control means including support means, said resilient means including a spring having one end acting on said flexible means and its other end acting on said support means of said force control means, said force control means including means to shift the position of said support means to change the length of said spring, and means to cause movement of said support means only in the axial direction of said spring when said shifting means shifts the position of said support means.

10. An automatic shut-off nozzle comprising a body having an inlet and an outlet, a valve in said body controlling flow of liquid from said inlet to said outlet, manual operated means controlling the operation of said valve, a spout communicating with said outlet and having its free end for disposition in an opening of a fill pipe of a vehicle tank or the like, release means to release said manual operated means to allow closing of said valve and stoppage of liquid flow, means to return vapor from the tank being filled, sealing means to form a seal between the fill pipe opening and said vapor return means when said spout is disposed in the fill pipe, responsive means responsive to the pressure in the sealed tank to cause said release means to close said valve to stop liquid flow through said body when the pressure in the sealed tank exceeds a predetermined pressure, means exerting a force on said responsive means in opposition to the pressure in the sealed tank acting on said responsive means, force control means to control the force exerted by said exerting means on said responsive means to cause said responsive means to respond at the predetermined pressure, said responsive means including flexible means having one side exposed to the pressure in the sealed tank, said exerting means including resilient means acting on the other side of said flexible means to exert a force on said flexible means, said force control means controlling the force exerted on said flexible means by said resilient means to control the predetermined pressure at which said responsive means responds, said force control means including support means, said resilient means including a spring having one end acting on said flexible means and its other end acting on said support means of said force control means, said force control means including shifting means to shift the position of said support means to change the length of said spring, means to cause movement of said support means only in the axial direction of said spring when said shifting means shifts the position of said support means, and said causing means including means to prevent rotation of said support means when said shifting means shifts the position of said support means.

11. The nozzle according to claim 10 including a fixed member, said shifting means being supported by said fixed member for motion only in the axial direction of said spring, and said fixed member having means to limit the movement of said shifting means toward said support means.

12. The nozzle according to claim 11 in which said rotation preventing means includes means supported by said fixed member and said support means having means to cooperate with said means supported by said fixed member.

13. The nozzle according to claim 12 in which said shifting means is a screw.

14. The nozzle according to claim 11 in which said shifting means is a screw.

15. The nozzle according to claim 10 in which said rotation preventing means includes fixed means and said support means having means to cooperate with said fixed means.

16. The nozzle according to claim 15 in which said shifting means is a screw.

17. A sub-assembly for securing to an automatic shut-off nozzle body and responsive to the pressure in the sealed tank including a valve seat, a cap, flexible means disposed between said valve seat and said cap and responsive to the pressure in the sealed tank when the sub-assembly is mounted on the nozzle body, means to secure said cap and said valve seat to each other with said flexible means therebetween to form the sub-assembly, first exerting means disposed within said cap and acting on said flexible means to exert a force in opposition to the pressure in the sealed tank acting on said flexible means, force control means carried by said cap to control the force exerted on said flexible means to cause said flexible means to respond to a predetermined pressure in the sealed tank to stop flow through the nozzle body, and at least one of said valve seat, said cap, and said flexible means including means to enable the sub-assembly to be secured to the nozzle body.

18. The sub-assembly according to claim 17 in which said flexible means is a diaphragm.

19. The sub-assembly according to claim 18 in which said force control means includes support means carried by said cap and said force exerting means includes a spring having one end acting on said diaphragm and its other end acting on said support means.

20. The sub-assembly according to claim 19 in which said force control means includes shifting means carried by said cap and acting on said support means to change the length of said spring.

21. The sub-assembly according to claim 20 including said shifting means shifting said support means to change the length of said spring and means carried by said cap and cooperating with said support means to cause motion of said support means only in the axial direction of said spring when said shifting means shifts the position of said support means.

22. The sub-assembly according to claim 17 in which said force control means includes support means carried by said cap and said force exerting means includes a spring having one end acting on said flexible means and its other end acting on said support means.

23. The sub-assembly according to claim 22 in which said force control means includes shifting means carried by said cap and acting on said support means to change the length of said spring.

24. The sub-assembly according to claim 23 including said shifting means shifting said support means to change the length of said spring and means carried by said cap and cooperating with said support means to cause motion of said support means only in the axial direction of said spring when said shifting means shifts the position of said support means.

25. An automatic shut-off nozzle comprising a body having an inlet and an outlet, a valve in said body controlling flow of liquid from said inlet to said outlet, manual operated means controlling the operation of said valve, a spout communicating with said outlet and having its free end for disposition in an opening of a fill pipe of a vehicle tank or the like, release means to release said manual operated means to allow closing of said valve and stoppage of liquid flow, means to return vapor from the tank being filled, sealing means to form a seal between the fill pipe opening and said vapor return means when said spout is disposed in the fill pipe, responsive means responsive to the pressure in the sealed tank to cause said release means to close said valve to stop liquid flow through said body when the pressure in the sealed tank exceeds a predetermined pressure, means exerting a force on said responsive means in opposition to the pressure in the sealed tank acting on said responsive means, force control means to control the force exerted by said exerting means on said responsive means to cause said responsive means to respond at the predetermined pressure, said responsive means including flexible means having one side exposed to the pressure in the sealed tank, said exerting means including resilient means acting on the other side of said flexible means to exert a force on said flexible means, said force control means controlling the force exerted on said flexible means by said resilient means to control the predetermined pressure at which said responsive means responds, said force control means including support means, said resilient means including a spring having one end acting on said flexible means and its other end acting on said support means of said force control means, said support means having means disposed within a portion of said spring adjacent the other end of said spring to support said spring, and said force control means including shifting means acting on said support means to shift the position of said support means to change the length of said spring.

26. An automatic shut-off nozzle comprising a body having an inlet and an outlet, a valve in said body controlling flow of liquid from said inlet to said outlet, manual operated means controlling the operation of said valve, a spout communicating with said outlet and having its free end for disposition in an opening of a fill pipe of a vehicle tank or the like, release means to release said manual operated means to allow closing of said valve and stoppage of liquid flow, means to return vapor from the tank being filled, sealing means to form a seal between the fill pipe opening and said vapor return means when said spout is disposed in the fill pipe, responsive means responsive to the pressure in the sealed tank to cause said release means to close said valve to stop liquid flow through said body when the pressure in the sealed tank exceeds a predetermined pressure, means exerting a force on said responsive means in opposition to the pressure in the sealed tank acting on said responsive means, force control means to control the force exerted by said exerting means on said responsive means to cause said responsive means to respond at the predetermined pressure, said responsive means including flexible means having one side exposed to the pressure in the sealed tank, said exerting means including resilient means acting on the other side of said flexible means to exert a force on said flexible means, said force control means controlling the force exerted on said flexible means by said resilient means to control the predetermined pressure at which said responsive means responds, said force control means including support means, said resilient means including a spring having one end acting on said flexible means and its other end acting on said support means of said force control means, said force control means including shifting means supperted by said body and exerting a force on said support means when said shifting means is moved relative to said body to shift the position of said support means to change the length of said spring, a fixed member, said shifting means being separate from said support means and supported by said fixed member, and said fixed member having means, separate from said shifting means and its support by said fixed member, cooperating with said support means to allow movement of said support means only in the axial direction of said spring when said shifting means shifts the position of said support means.

* * * * *